US005338187A

United States Patent [19]

Elharar

[11] Patent Number: 5,338,187

[45] Date of Patent: Aug. 16, 1994

[54] CANDLE AND METHOD OF MAKING SAME

[76] Inventor: Shimon Elharar, 4 Yehudit Street, Entrance B, 94344 Jerusalem, Israel

[21] Appl. No.: 126,159

[22] Filed: Sep. 24, 1993

[30] Foreign Application Priority Data

Oct. 8, 1992 [IL] Israel ..... 103385
Jan. 8, 1993 [IL] Israel ..... 104344

[51] Int. Cl.[5] ..... F23D 3/16

[52] U.S. Cl. ..... 431/288; 431/289; 431/320

[58] Field of Search ..... 431/288, 289, 290, 295, 431/296, 297, 320, 322, 326; 362/159, 161

[56] References Cited

U.S. PATENT DOCUMENTS 2,058,584 10/1936 Gastel ..... 431/288
2,291,072 7/1942 Dahle ..... 431/291
3,428,409 2/1969 Summers ..... 431/289
3,462,235 8/1969 Summers ..... 431/289
3,998,922 12/1976 Weiss ..... 431/289
4,332,548 6/1982 Linton ..... 431/288

*Primary Examiner*—James C. Yeung
*Attorney, Agent, or Firm*—Benjamin J. Barish

[57] ABSTRACT

A candle, comprising: a container closed at its bottom and open at its top; a first combustible material within the container, which material is liquid at room temperature; a second combustible material, which is solid at room temperature, overlying the first combustible material and closing the open top of the container; and a wick immersed in the first combustible material and projecting outwardly through the second combustible material. The second combustible material is liquified by heat at the time of its application and is of a density lower than that of the first combustible material so as to float thereover as it solidifies.

20 Claims, 1 Drawing Sheet

CANDLE AND METHOD OF MAKING SAME

FIELD AND BACKGROUND OF THE INVENTION

The present invention relates to candles, and particularly to candles which may be used for religious ceremonial purposes.

Candles used for religious ceremonial purposes are generally made of wax, which is solid at room temperature and therefore enables easy handling and storage of the candles. However, there are many occasions where it is preferable, at least by some persons, to use a liquid candle, i.e., a candle which includes a wick immersed in an oil or other combustible material liquid at room temperature. Such candles are less convenient to prepare, handle and store, because of the liquid nature of the combustible material.

OBJECTS AND BRIEF SUMMARY OF THE INVENTION

An object of the present invention is to provide a candle which is primarily of liquid form but which provides the advantages of solid candles with respect to the ease and convenience of using, handling and storing the candle. Another object of the invention is to provide a method of making such a candle.

According to the present invention, there is provided a candle comprising: a container closed at its bottom and open at its top; a first combustible material within the container, which material is liquid at room temperature; a second combustible material, which is solid at room temperature, overlying the first combustible material and closing the open top of the container; and a wick immersed in the first combustible material and projecting outwardly through the second combustible material.

According to further features in the preferred embodiments of the invention described below, the second combustible material is of a lower density than the first combustible material when both materials are in the liquid state.

According to other embodiments described herein, the end of the wick projecting outwardly through the second combustible material is in contact with the inner face of the container so as to be supported thereby.

According to still further embodiments described herein, the upper end of the wick projecting outwardly through the second combustible material is supported centrally of the container by a stiff wire having a central section engaging the wick, and at least one end section engaging a side of the container.

According to another aspect of the present invention, there is provided a method of making a candle comprising pouring a first combustible material which is liquid at room temperature into a container having a closed bottom and an open top; pouring over the first combustible material a second combustible material to cover the first combustible material and to close the open top of the container; the second combustible material being solid at room temperature, being liquified by heat at the time it is poured over the first combustible material, and being of a density lower than that of the first combustible material so as to float thereover as it solidifies by cooling to room temperature; and immersing a wick in the first combustible material to project outwardly through the second combustible material.

According to further features in the described preferred embodiments, the wick is first passed through a body which is of lower density than either of the combustible materials, such that the body floats over the combustible materials and supports the wick thereover until the second combustible material solidifies. In addition, the wick includes a weight at its lower end of higher density than either of the combustible materials, such that the weight maintains the wick in a vertical condition in the container.

The wick may be applied after the first combustible material has been applied but before the second combustible material has been applied; alternatively, the wick may be applied after both of the combustible materials have been applied but before the second combustible material has solidified by cooling.

It will be seen that a candle constructed in accordance with the foregoing features provides liquid candles with the advantages of solid candles in the ease and convenience in using, handling and storing the candles.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
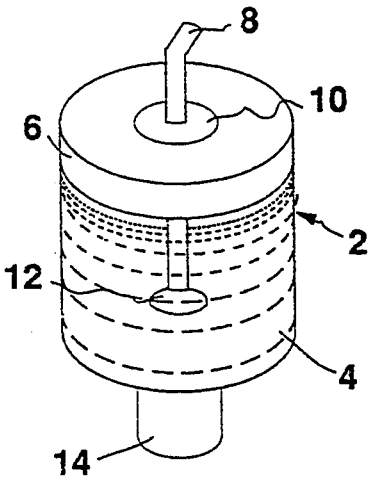
FIG. 1 is a three-dimensional view illustrating one form of candle constructed in accordance with the present invention.

The candle illustrated in FIG. 1 comprises a container 2 of cup-shape, closed at its bottom and open at its top. The container 2 includes a first combustible material 4 which is liquid at room temperature. A suitable material for this purpose is a vegetable oil, such as olive oil or soya bean oil. Oil 4 substantially fills the container to a level just below its open top. A second combustible material 6, which is solid at room temperature, covers the top of the liquid oil 4 and also closes the top of the container 2. Combustible material 6 is preferably of wax, such as used in making conventional wax-type candles, and of a density lower than that of the oil 4, so that it can be applied in heated liquid form over the oil 4 to float thereon until it solidifies by cooling to room temperature.

The candle illustrated in FIG. 1 further includes a wick 8 which is immersed in the oil 4 and projects outwardly of the wax layer 6 so as to be readily ignited by the user. Before the wick 8 is applied to the candle, it is preferably passed through a body 10 of lower density than the oil 4 so that it floats in the oil and thus keeps the upper end of the wick above the oil. Body 10 may be a cork. Preferably, the lower end of the wick carries a weight 12 which is of higher density than the oil 4 so as to keep the wick in substantially vertical form within the oil.

As seen in FIG. 1, the wick 8 is of a length to terminate short of the bottom of the container 2. Thus, as the oil drawn up via the wick is consumed, the level of the oil lowers and the wax layer, floating on the oil, lowers correspondingly within the container 2 until all the oil 4 and the wax 6 is consumed. Alternatively, the wick 8 may of a length to reach the bottom of the container so that the wick continuously remains immersed in the oil as the oil is consumed.

The wick may also be applied after the wax layer 6 has been applied, but before it begins to harden by cooling. In either case, the float 10 supports the wick in the illustrated vertical condition until the wax 6 hardens.

Figure 2:
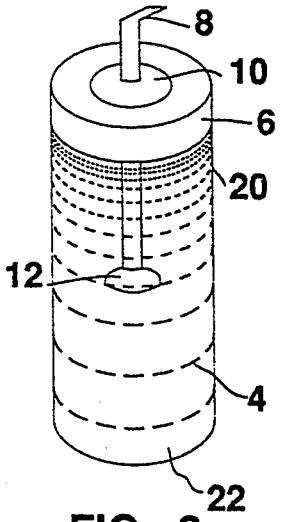
FIG. 2 is a similar view of a second form of candle constructed in accordance with the present invention.

The candle illustrated in FIG. 1 includes a stem 14 depending from the bottom of the container 2 and of smaller diameter than the container, for supporting the candle in a socket of a candle holder. FIG. 2 illustrates a variation wherein the bottom 22 of the container 20 is flat for supporting the candle on a flat supporting surface, or in the socket of a candle holder.

While FIGS. 1 and 2 of the drawings illustrate the container 2 as being of cylindrical configuration, it will be appreciated that the container can be of other configurations, for example of cubical configuration.

Figure 3:
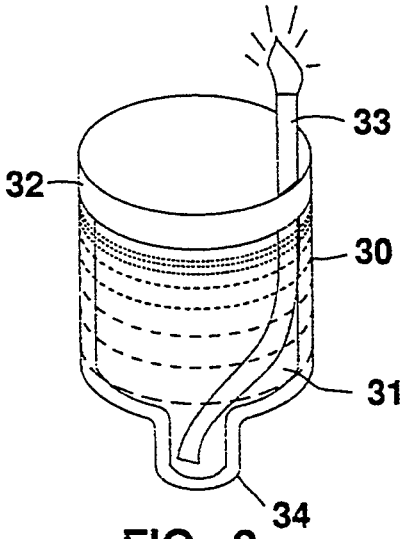
FIGS. 3–6 illustrate four further candle constructions in accordance with the present invention.

The candle illustrated in FIG. 3 includes a container 30 of cup-shape, closed at its bottom and open at its top. The container 30 includes a first combustible material 31 which is liquid at room temperature, and a second combustible material 32 which is solid at room temperature. Material 32 covers the top of the first material 31 and also the open top of the container 30. A wick 33 is immersed in the lower combustible material 31 and projects outwardly of the upper combustible material 32. Container 30 is further formed with a stem 34 depending centrally from its bottom and of smaller diameter than the container, for supporting the candle in a socket of a candle holder.

The two combustible materials 31 and 32 in the example illustrated in FIG. 3, as well as in the other examples illustrated in FIGS. 4–6 to be described below, may be the same materials as described above; for example, combustible material 31 may be olive oil or soya bean oil; and combustible material 32 may be conventional wax such as used in making conventional wax-type candles. Container 30 may be transparent glass.

In the embodiment illustrated in FIG. 3, the end of the wick 33 projecting outwardly through the solid combustible material 32 is in contact with the inner face of the container 30. Thus, the container itself helps to support the wick in its upright position, thereby decreasing the chances that it may drop over into the melted pool of wax and oil during the burning of the candle. The end of wick 33 immersed in the combustible material 31 is located within the hollow stem 34 formed in the bottom of the container.

Figure 4:
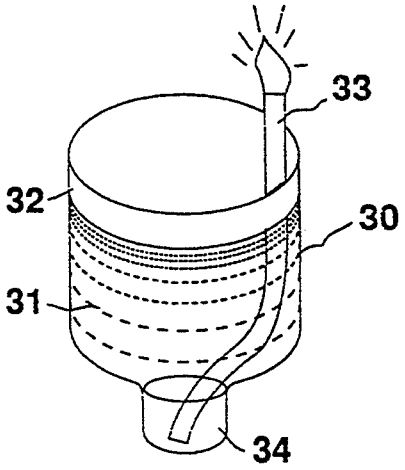

FIG. 4 illustrates an arrangement similar to that of FIG. 3, but with the further variation that the hollow stem 34 at the bottom of the container is filled with wax which is solidified before the oil is applied. This better assures that the respective end of the wick will be retained within the hollow stem during the manufacture of the candle.

Figure 5:
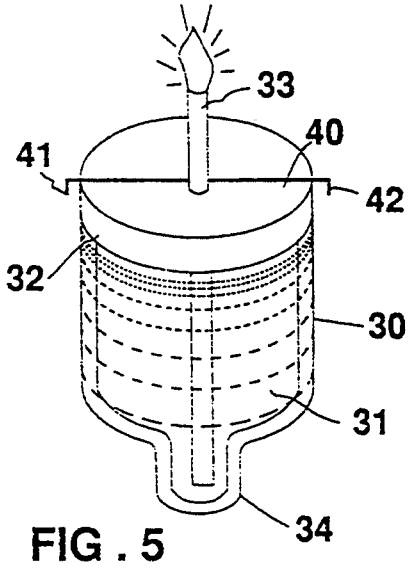

FIG. 5 illustrates a variation, particularly useful for larger-diameter candles. In this variation, the upper end of the wick 33 projecting outwardly of the candle is supported centrally of the container by a stiff wire 40 passing through the wick 33. The central area of the wire thus engages and supports the wick. The wire is in turn supported on the container 30 by a pair of downturned bends 41, 42 at the opposite ends of the wire and engageable with the sides of the container.

Figure 6:
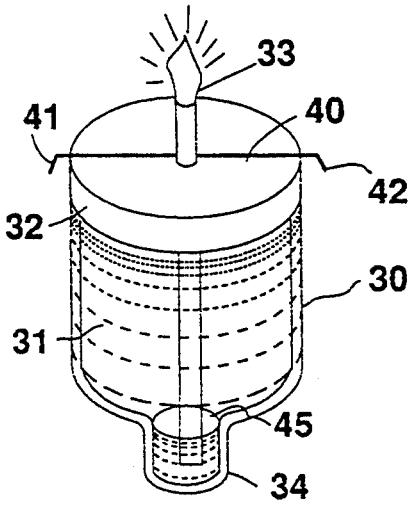

FIG. 6 illustrates a further variation, similar to that of FIG. 5, except that the lower end of the wick 33 immersed in combustible material 31 is secured to a flat horizontal disc 45 adjacent to the bottom of the container, which disc aids in supporting the lower end of the wick in the combustible material.

While the invention has been described with respect to several preferred embodiments, it will be appreciated that these are set forth merely for purposes of example, and that many other variations, modifications and applications of the invention may be made.

What is claimed is:

1. A candle, comprising:

a container closed at its bottom and open at its top;

a first combustible material within the container, which material is liquid at room temperature;

a second combustible material, which is solid at room temperature, overlying the first combustible material and closing the open top of the container;

and a wick immersed in said first combustible material and projecting outwardly through said second combustible material.

2. The candle according to claim 1, wherein said second combustible material is of a lower density than said first combustible material when both materials are in the liquid state.

3. The candle according to claim 1, wherein said wick is passed through a body which is of lower density than either of said combustible materials.

4. The candle according to claim 1, wherein said wick includes a weight at its lower end of higher density than either of said combustible materials such that the weight maintains the wick in a vertical condition in said container.

5. The candle according to claim 1, wherein said closed bottom of the container is formed with a depending stem for supporting the candle in a socket of a candle holder.

6. The candle according to claim 1, wherein said closed bottom of the container is flat for supporting the candle on a flat supporting surface.

7. The candle according to claim 1, wherein said first combustible material is a vegetable oil, and said second combustible material is wax.

8. The candle according to claim 1, wherein said container is transparent.

9. A candle according to claim 1, wherein the end of the wick projecting outwardly through the second combustible material is in contact with the inner face of the container so as to be supported thereby.

10. The candle according to claim 9, wherein the end of said wick immersed in said first combustible material is located centrally of the container.

11. The candle according to claim 10, wherein the container is formed with a stem depending centrally from its bottom and of smaller diameter than the container for supporting the candle in a socket of a candle holder.

12. The candle according to claim 11, wherein said depending stem is filled with a combustible material which is solid at room temperature and which receives said opposite end of the wick.

13. The candle according to claim 1, wherein the end of the wick projecting outwardly through the second combustible material is supported centrally of the container by a stiff wire having a central section engaging the wick, and at least one end section engaging a side of the container.

14. The candle according to claim 13, wherein the opposite ends of said stiff wire engage the opposite sides of the container.

15. The candle according to claim 14, wherein said stiff wire is of metal and its central section passes through said wick.

16. The candle according to claim 1, wherein the end of the wick immersed in said first combustible material is secured to a flat disc adjacent to the bottom of said container.

17. A method of making a candle, comprising:

pouring a first combustible material which is liquid at room temperature into a container having a closed bottom and an open top;

pouring over said first combustible material a second combustible material to cover the first combustible material and to close the open top of the container; said second combustible material being solid at room temperature, being liquified by heat at the time it is poured over said first combustible material, and being of a density lower than that of said first combustible material so as to float thereover as it solidifies by cooling to room temperature;

and immersing a wick in said first combustible material to project outwardly through said second combustible material.

18. The method according to claim 17, wherein said wick is first passed through a body which is of lower density than either of said combustible materials, such that said body floats over said combustible materials and supports the wick thereover until the second combustible material solidifies.

19. The method according to claim 17, wherein said wick is applied after the first combustible material has been applied to the container but before the second combustible material has been applied to the container.

20. The method according to claim 17, wherein said wick is applied after both of said combustible materials have been applied to the container, but before the second combustible material has solidified by cooling.

* * * * *